US009574860B1

(12) United States Patent
Mobley

(10) Patent No.: US 9,574,860 B1
(45) Date of Patent: Feb. 21, 2017

(54) AMMUNITION CASING RESIZER

(71) Applicant: George Wayne Mobley, Hampton Cove, AL (US)

(72) Inventor: George Wayne Mobley, Hampton Cove, AL (US)

( * ) Notice: Subject to any disclaimer, the term of this patent is extended or adjusted under 35 U.S.C. 154(b) by 0 days.

(21) Appl. No.: 14/827,501

(22) Filed: Aug. 17, 2015

Related U.S. Application Data

(60) Provisional application No. 62/037,734, filed on Aug. 15, 2014.

(51) Int. Cl.
*F42B 33/10* (2006.01)

(52) U.S. Cl.
CPC ..... *F42B 33/10* (2013.01)

(58) Field of Classification Search
CPC ..... F42B 33/10; F42B 33/00; F42B 33/002; F42B 33/004; F42B 33/04
USPC ..... 86/24
See application file for complete search history.

(56) References Cited

U.S. PATENT DOCUMENTS 2,901,209 A * 8/1959 Bardy ..... B65B 1/46 141/144
2,939,176 A * 6/1960 Adelman ..... C06B 21/0075 264/3.1
3,049,044 A * 8/1962 English ..... F42B 33/02 86/24
3,735,666 A * 5/1973 Decker ..... F42B 33/10 86/24
3,771,411 A * 11/1973 Hazel ..... F42B 33/004 86/24
3,952,628 A * 4/1976 Boswell ..... F42B 3/198 29/610.1
4,040,329 A * 8/1977 Ljungberg ..... F42D 1/10 102/313
4,051,988 A * 10/1977 Egerstrom ..... F42D 1/08 166/77.4
4,510,842 A * 4/1985 Hlusko ..... F42B 33/10 86/24
4,512,235 A * 4/1985 Lee ..... B30B 1/04 86/23
4,593,598 A * 6/1986 Gunder ..... F42B 33/10 72/352
5,202,529 A * 4/1993 Shields ..... F42B 33/004 86/23
5,221,806 A * 6/1993 Chaney ..... F42B 33/04 86/19

(Continued)

*Primary Examiner* — Michael David
(74) *Attorney, Agent, or Firm* — Peter Loffler

(57) ABSTRACT

A simple ammunition casing resizer helps eliminate the problem of the casing becoming frictionally stuck with the resizing die. The ammunition casing resizer is a table top secured base that has a die plate located above the base with the resizing die removably secured within the die plate. A resizing frame reciprocates in up and down fashion under the guidance of either a manually controlled handle or an electrical motor. A ram is positioned below the resizing die while a push rod is positioned above the die such that the ram and push rod, each attached to the frame, travel in up and down reciprocating lockstep. As the ram travels upwardly, the ram presses a casing into the die for resizing and as the ram travels downwardly, the push rod passes through the top of the die and into the interior of the casing, pushing the casing out of the die.

10 Claims, 6 Drawing Sheets

(56) References Cited

U.S. PATENT DOCUMENTS

| | | | | | |
|---|---|---|---|---|---|
| 5,635,661 | A * | 6/1997 | Tuftee | F42B 33/10 | 86/24 |
| 5,649,465 | A * | 7/1997 | Beebe | F42B 33/10 | 86/1.1 |
| 5,763,810 | A * | 6/1998 | Lee | F42B 33/002 | 86/23 |
| 6,397,720 | B1 * | 6/2002 | Fox | F42B 33/10 | 86/23 |
| 8,783,509 | B2 * | 7/2014 | Nordlund | G01F 11/24 | 141/196 |
| 2004/0025677 | A1 * | 2/2004 | Koch | F42B 33/10 | 86/24 |
| 2012/0160081 | A1 * | 6/2012 | Beebe | F42B 33/10 | 86/24 |
| 2013/0112100 | A1 * | 5/2013 | Bunczk | F42B 10/40 | 102/374 |
| 2013/0152771 | A1 * | 6/2013 | Coma Asensio | B65G 47/1457 | 86/19.5 |
| 2013/0180392 | A1 * | 7/2013 | Nuetzman | F42B 5/28 | 86/19.6 |
| 2015/0159985 | A1 * | 6/2015 | Keska | F42B 35/02 | 86/24 |

* cited by examiner

AMMUNITION CASING RESIZER

This application claims the benefit of U.S. Provisional patent application, No. 62/037,734, filed on Aug. 15, 2015, which provisional application is incorporated by reference herein, in its entirety.

BACKGROUND OF THE INVENTION

1. Field of the Invention

The present invention relates to an ammunition casing resizer for reloading of the casing wherein the casing is sized along its entire length from the casing's mouth to its extraction groove or rim and wherein the opportunity for the casing to become stuck or otherwise adhered to the resizing dye, is minimized.

2. Background of the Prior Art

The firing of a round of ammunition from a firearm is an extremely violent act. Primer within the round ignites causing the propellant within the round to burn. The chemical reaction created by the burning propellant causes an extremely rapid expansion of gas within the round. This rapid gas expansion, which some consider to be an explosion, although it is not, causes the bullet held by the ammunition casing to overcome the frictional resistance imposed by the casing and be discharged out of the muzzle of the firearm at high velocity. During the gas expansion created by the propellant ignition, the ammunition casing, typically, although not exclusively made of brass, expands and presses against the inside wall of the gun's chamber. After bullet discharge, the casing retracts somewhat from its expansion, but not to its original size. As many firearm owners desire to reuse the casing, as opposed to either recycling the brass or simply tossing the casing into a trash receptacle, the casing needs to be resized back its original size—or as close to its original size as acceptable tolerances allow.

Toward this end, resizing systems have been proposed. Such systems, which come in a wide variety of architectures and work with varying degrees of efficiency, use a resizing die, sized to the appropriate dimensions, and press the die into the casing in order to effect resizing.

A fundamental problem with ammunition resizing systems concerns the frictional engagement of the steel resizing die with the brass casing. Considerable force is required in order to press the steel die into the brass casing in order to resize the casing. As a result, the die and casing can become frictionally stuck to one another requiring the need to separate the two which is not only time-consuming and frustrating, but can also damage the casing. In order to address this problem, a lubricant is used, either a wet lubricant or a dry lubricant. While each type of lubricant offers benefits, each has drawbacks, either in labor intensity in the use of the lubricant or the need to allow the lubricant, as in the case of a dry lubricant, to dry thoroughly prior to casing resizing. Additionally, the use of a lubricant can be problematic in that if too much lubricant is used, the primer and/or propellant can become fouled, leading to ammunition failure, or chambering or ejection can be compromised if the lubricant builds up on the outside of the ammunition.

What is needed is a ammunition casing resizing system that helps prevent the casing becoming stuck to the resizing die without the need to use an expensive carbide resizing die and without excessive reliance on lubricants to perform the resizing task. Such a resizing system must be of relatively simple design and construction and must be easy to use in order to allow appropriate resizing throughput.

SUMMARY OF THE INVENTION

The ammunition casing resizer of the present invention addresses the aforementioned needs in the art by providing a casing resizing system wherein s shell or casing holder is eliminated so as not to restrict the distance the casing can be pressed into the resizing die, allowing the casing to be resized from its mouth to its extraction groove or rim. Once the casing is resized by a die, the two easily separate from one another, reducing the need for excessive reliance on lubricants during the resizing process, and reducing the need to manually separate the two with a screw driver or similar implement. The ammunition casing resizer is of relatively simple design and construction, being produced using standard manufacturing techniques, so as to be relatively inexpensive to produce in order to be economically attractive to potential consumer for this type of product. The ammunition casing resizer allows for rapid resizing throughput and can be configured as a simple, inexpensive manual system or an electrical based system that uses either a small AC or DC motor for control of the process. The ammunition casing resizer accomplishes its resizing task by eliminating the casing holder that is used in conventional resizing systems and by using a simple push rod that pushes the casing from the die from above—as opposed to pulling the casing from below the die as is conventional when using a casing holder—thereby allowing for reliable separation of casing and resizing die.

The ammunition casing resizer of the present invention is comprised of a base that is attached to an appropriate work surface (bench, table, etc.,), in appropriate fashion. A die plate is located above the base and removably receives an ammunition resizing die. The resizing die has a top and a bottom. A ram passes through the base. The ram reciprocates between a first position wherein the ram is located a first distance below the resizing die and a second position wherein the ram is located a second distance below the resizing die. The ammunition casing is positioned on a top surface of the ram. As the ram travels from the first position to the second position, the ammunition casing is pressed into the resizing die through the bottom of the resizing die resulting in casing resizing in the usual way. A push rod is attached to the ram such that the push rod reciprocates in lock-step with the reciprocation of the ram and such that the push rod travels between a third position whenever the ram is in the first position and a fourth position whenever the ram is in the second position, As the push rod travels from the fourth position to the third position, the push rod protrudes through the top of the resizing die and travels toward the bottom of the resizing die eventually pressing on the base of the casing within the casing's interior so as to help disengage the casing from the resizing die. The ram is attached to the push rod via a frame. The top surface of the ram is flat—no conventional casing holder. A handle system is pivotally attached to the base and is attached to the ram such that reciprocation of the ram is under control of the handle system. Alternately, or in addition, a servomotor is attached to the ram such that reciprocation of the ram is under control of the servomotor.

BRIEF DESCRIPTION OF THE DRAWINGS

Similar reference numerals refer to similar parts throughout the several views of the drawings.

DESCRIPTION OF THE PREFERRED EMBODIMENT

Figure 1:
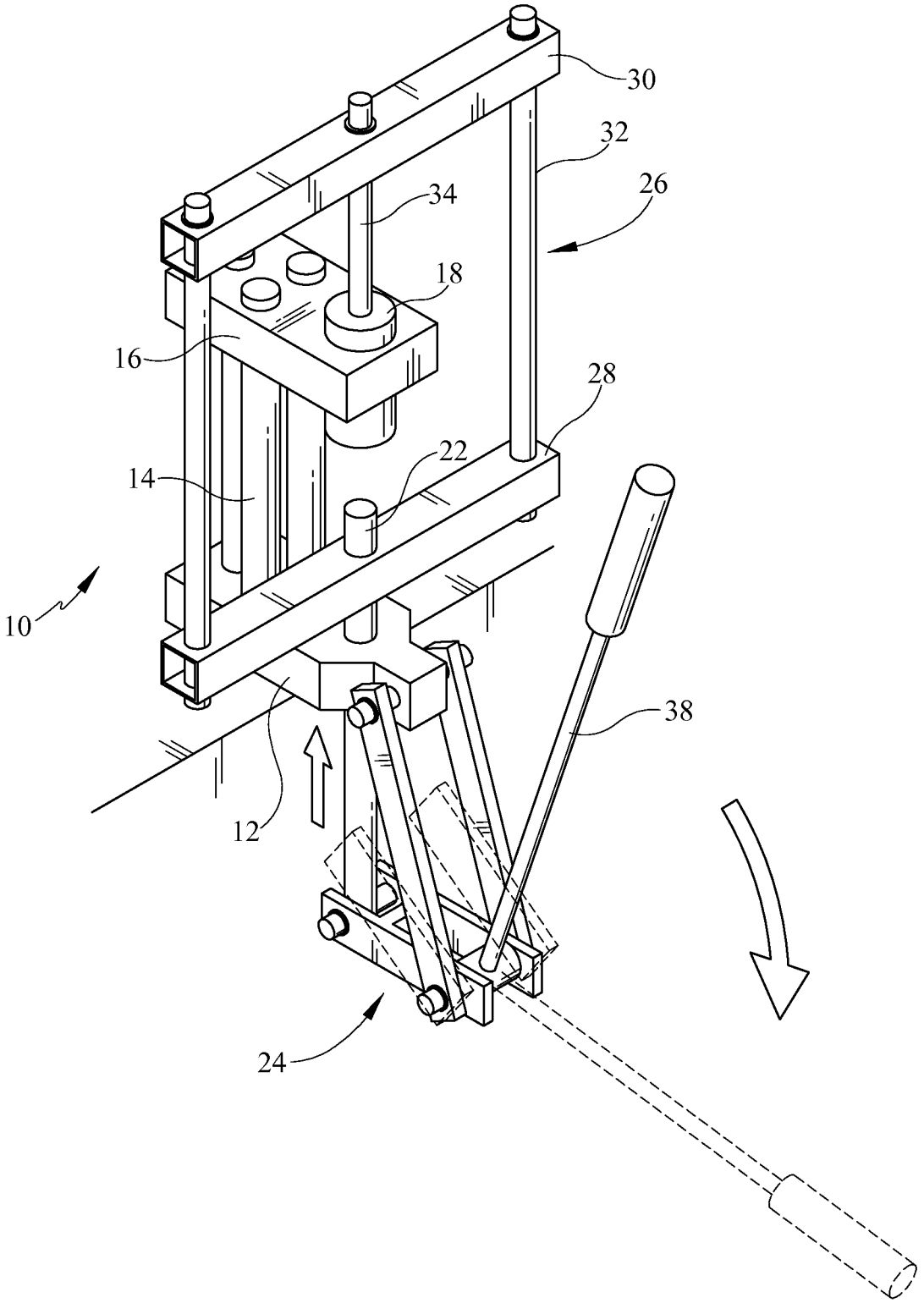
FIG. 1 is a perspective view of the ammunition casing resizer of the present invention.
Figure 2:
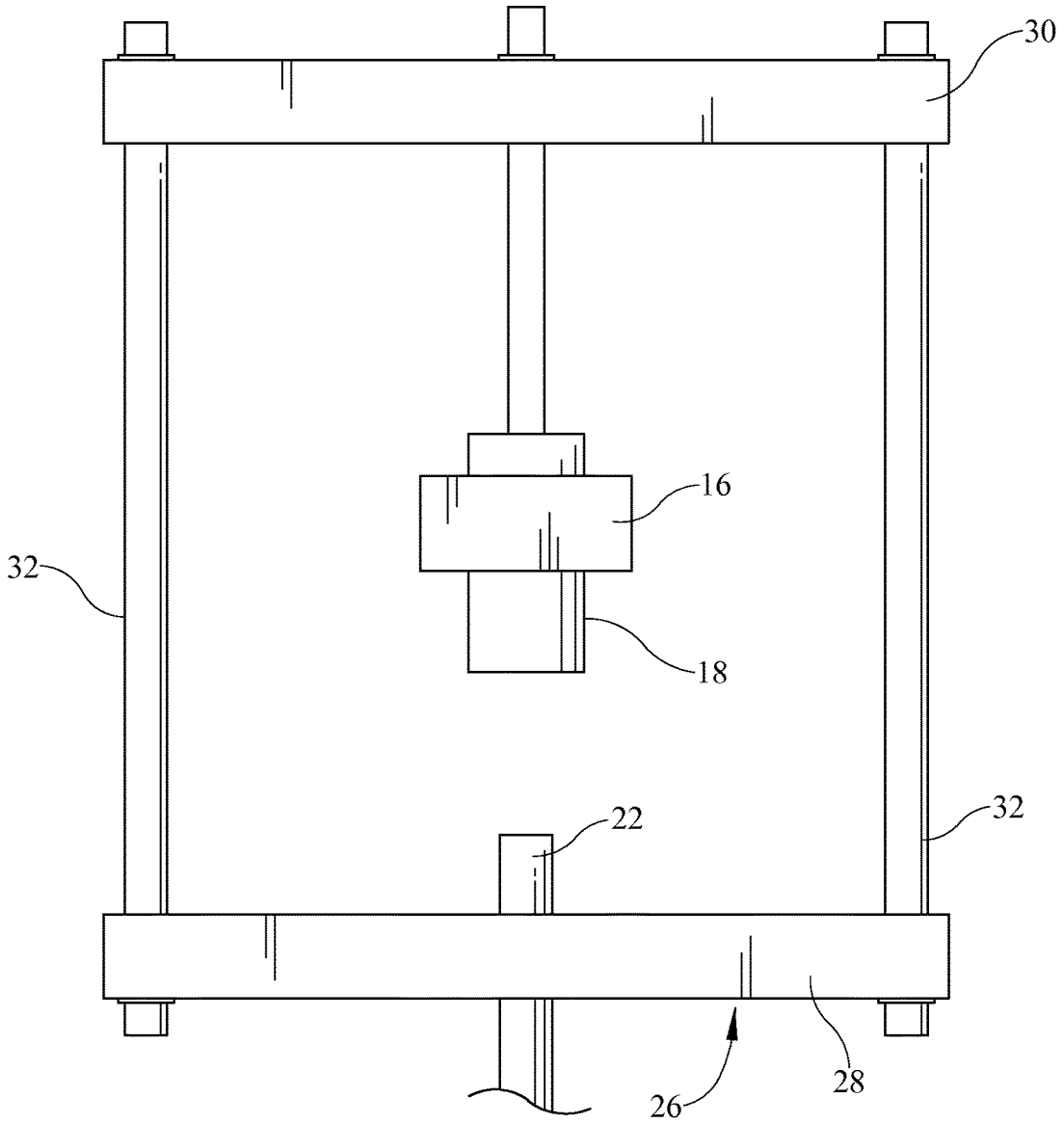
FIG. 2 is an elevation view of the ammunition casing resizer in its initial state.
Figure 3:
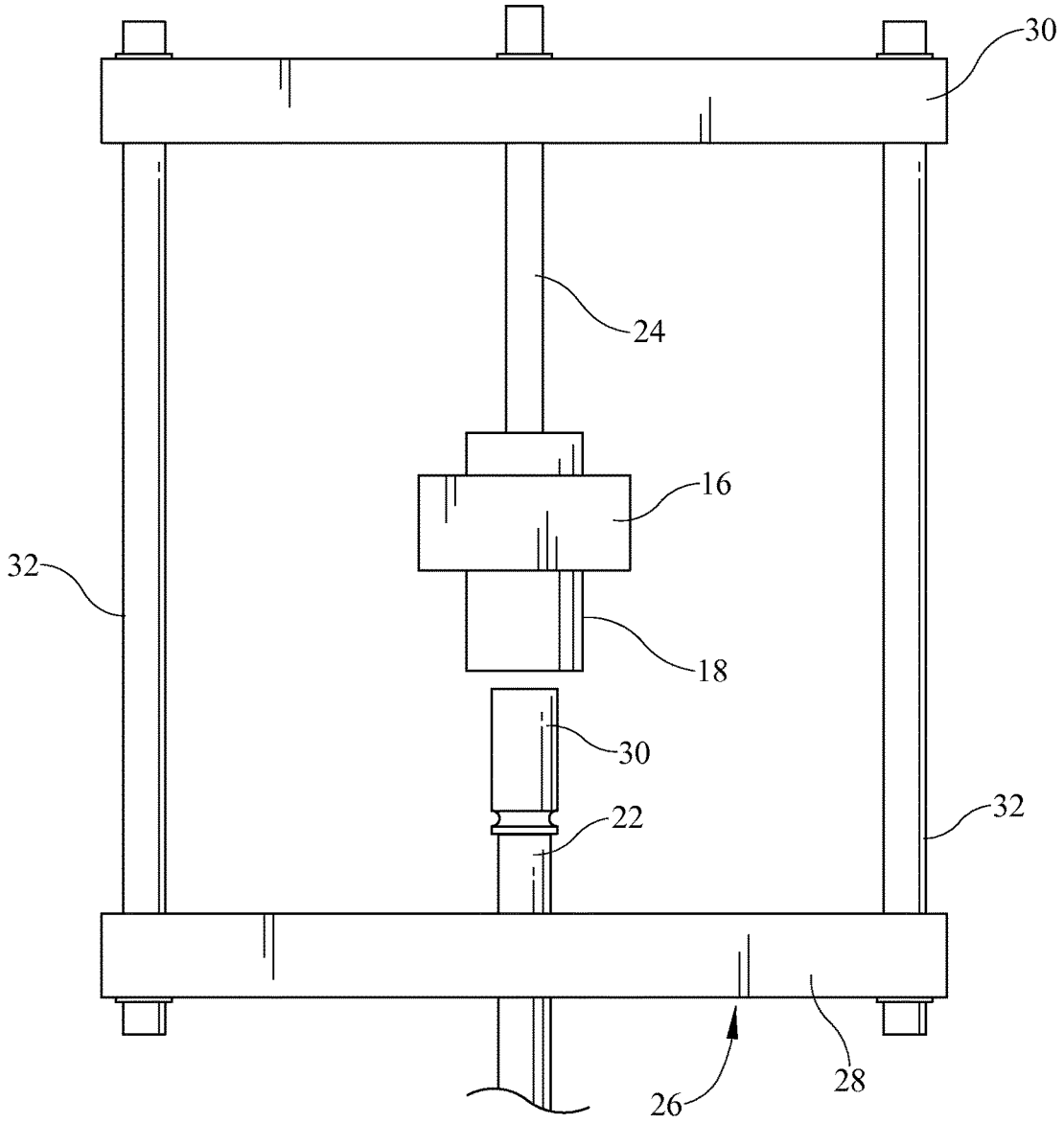
FIG. 3 is an elevation view of the ammunition casing resizer with a casing being lifted toward a resizing die.
Figure 4:
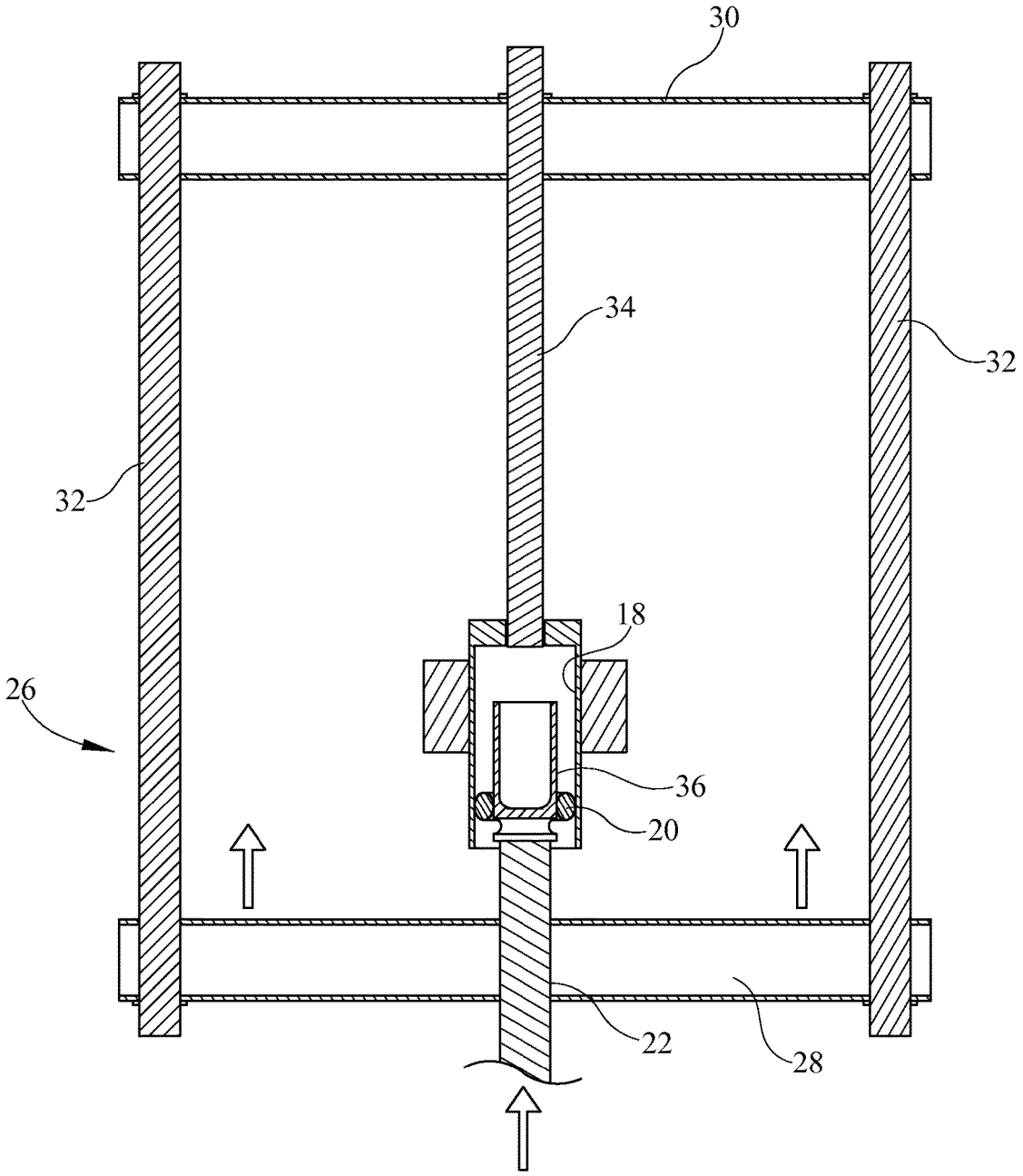
FIG. 4 is a sectioned elevation view illustrating the impingement of the casing onto the resizing die.
Figure 5:
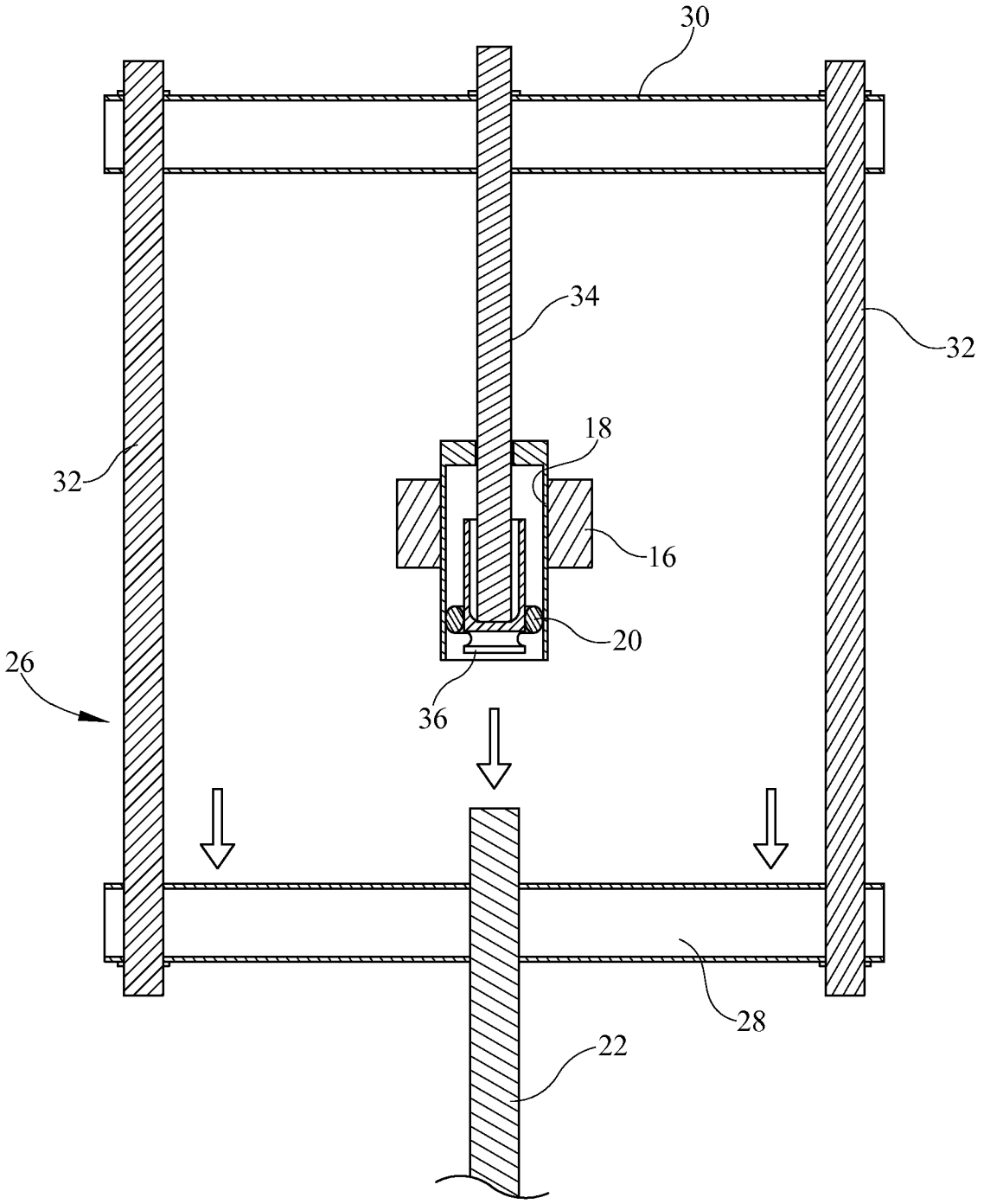
FIG. 5 is a sectioned elevation view illustrating the retraction of the casing ram after the resizing task has been completed, allowing for the resized casing to gravitationally fall free of the die.

Referring now to the drawings, it is seen that the ammunition casing resizer of the present invention, generally denoted by reference numeral 10, is comprised of base 12 of appropriate configuration such that the base 12 is secured to an appropriate work surface (table T, bench, etc.,) in any appropriate fashion. As seen, one or more upwardly extending stanchions 14 extend upwardly from the base 12 such that a die plate 16 is held at the upper end of the stanchions 14. The die plate 16 removably holds a resizing die 18 of any appropriate design known in the art in appropriate fashion such as via friction, screw in, etc., the resizing die 18 having a resizing ring 20 therein as is well known in the art.

Figure 6:
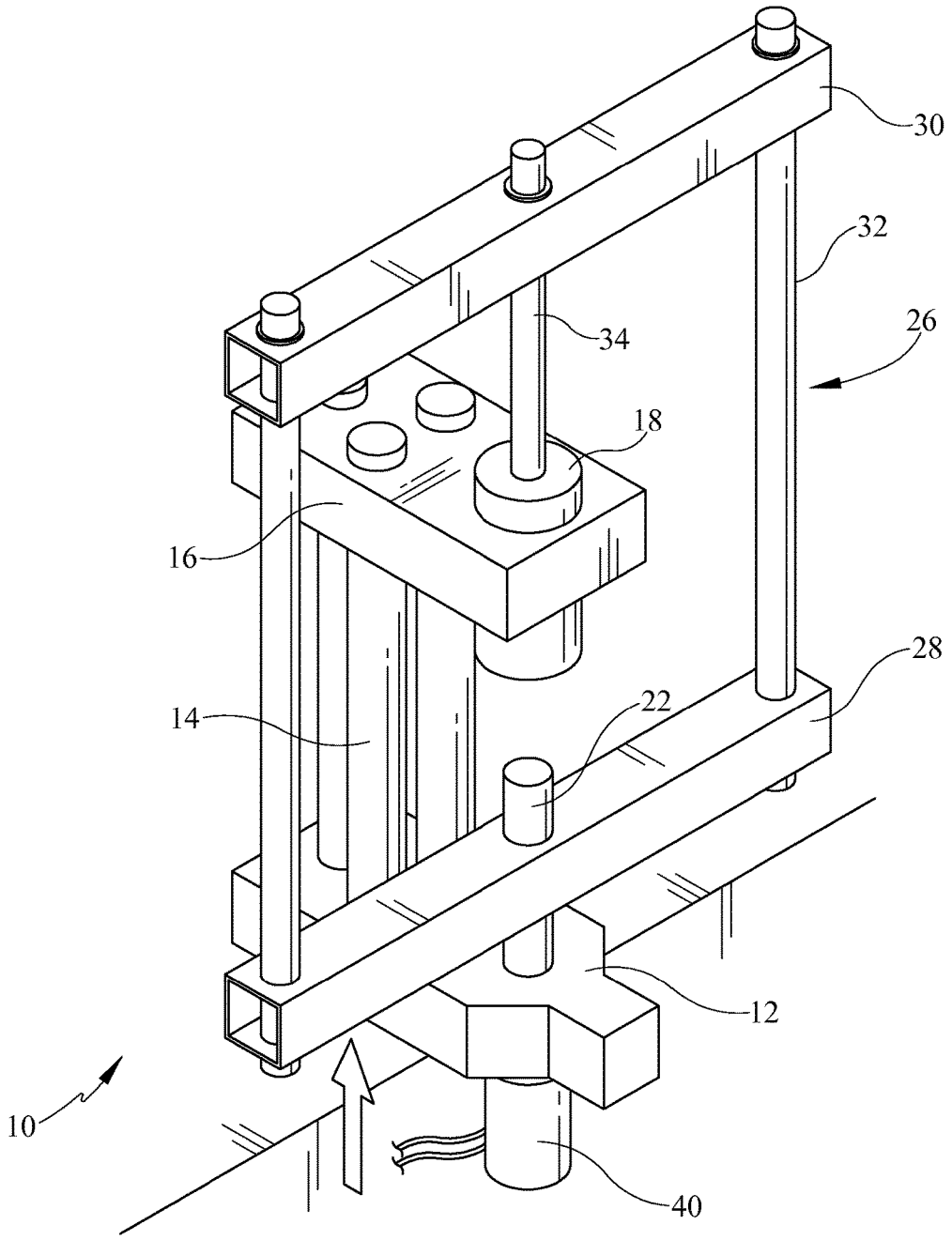
FIG. 6 is a perspective view of the ammunition casing resizer using an electric motor for its reciprocation of the ram and push rod.

A ram 22 passes through the base 12 under control of a reciprocating handle system 24 that reciprocates the ram 22 up and down, the handle system 24 also being pivotally attached to the base 12 in order to allow reciprocation of the handle system 24 and its attached implements. As seen in FIG. 6, is in lieu of, or in addition to the handle system 24, a small servo-motor 40, operating under either AC or DC electrical power, can be used to reciprocate the ram 22 in its up and down travel. Use of an electrical motor 40 can be automatic, such that the ram 22 is reciprocated at regular intervals or can be controlled via an appropriate operator switch (foot switch, hand switch, voice operated switch (not illustrated), etc.,) in order to allow the operator to control the speed of reciprocation.

Securely attached to the ram 22 is a resizing frame 26 that is generally rectangular in shape (or other appropriate shape as desired—in an extremely simple iteration of the ammunition casing resizer, the frame can be a single rod). The frame 26 has a lower bar 28 attached to the ram 22 in appropriate fashion (welded, bolted, etc.,), and also has an upper bar 30 joined by a pair of side bars 32. Attached to the upper bar 30 is a push rod 34 that passes through the resizing die 18 as more fully explained below.

In order to use the ammunition casing resizer 10 of the present invention, the base 12 is securely attached to a desired surface in appropriate fashion. The resizing frame 26 is positioned in an initial state wherein the ram 22 is in its lowermost position with respect to the die plate 16. A resizing die 18 of the desired size is secured to the die plate 16 in appropriate fashion. A casing 36 to be resized is positioned on the top of the ram 22, there being no casing holder present, the top surface of the ram being simply flat to accept the casing 36. The casing 36, sitting atop the top of the ram 22, is below the resizing die 18. The push rod 34 protrudes through the resizing die 18. Thereafter, the handle system 24 is articulated by pulling the handle 38 downwardly causing the ram 22 and the attached resizing frame 26 to travel upwardly, causing the casing 36 positioned on the top of the ram 22 to be pressed into the resizing die 18 in order for the resizing die 18 to resize the casing 36 in appropriate fashion, the resizing ring 20 helping to steady the casing 36 during the resizing process. During upward resizing frame 26 travel, the push rod 34 travels upwardly although the push rod 34 maintains its protrusion through the resizing die 18 via the die's top.

Once the casing 36 is resized, the handle 38 is pushed back upwardly causing the ram 22 and its attached resizing frame 26 to travel back downwardly. As the casing 36 is pressed within the resizing die 18, the downward movement of the ram 22 causes the ram 22 to separate from the bottom of the casing 36 as the casing 36 sticks to the resizing die 18. As this occurs, the push rod 34, traveling in lock-step with the downward traveling ram 22 and attached frame 26, penetrates deeper into the resizing die 18 and also penetrates the interior of the casing 36—depending on the dimensions of the push rod 34 and the length of reciprocating travel of the ram 22, the attached frame 26 and its attached push rod 34, the push rod 34 may penetrate the interior of the casing 36 when the casing is moving upwardly into pressing engagement with the resizing die 18. The downwardly traveling push rod 34 eventually engages the base of the casing 36 within the casing's interior so as to push the casing 36 out of the resizing die 18 thereby separating the two, allowing the casing 36 to simply gravitationally disengage from the device. The ammunition casing resizer 10 is ready for its next casing resizing iteration.

Of course, and as discussed previously, in lieu of the use of the handle system 24 for reciprocation of the ram 22, the frame 26, and the push rod 34, a servo-motor 40 can be used to effect up and down ram 22, frame 26, and push rod 34 travel.

The various components of the ammunition casing resizer 10 are made from appropriate materials, such as steel or aluminum.

While the invention has been particularly shown and described with reference to an embodiment thereof, it will be appreciated by those skilled in the art that various changes in form and detail may be made without departing from the spirit and scope of the invention.

I claim:

1. A resizing system for resizing an ammunition casing, the resizing system comprising:

a base having a die plate, the die plate receiving an ammunition resizing die, the resizing die having a top and a bottom;

a ram passing through the base, the ram reciprocating between a first position located a first distance below the resizing die and a second position located a second distance below the resizing die such that the ammunition casing is adapted to be positioned on a top surface of the ram, as the ram travels from the first position to the second position, the ammunition casing is pressed into the resizing die through the bottom of the resizing die; and a push rod attached to the ram such that the push rod reciprocates constantly in lock-step with the reciprocation of the ram and such that the push rod travels between a third position whenever the ram is in the first position and a fourth position whenever the ram is in the second position and such that when the push rod travels from the fourth position to the third position, the push rod protrudes through the top of the resizing die and travels toward the bottom of the resizing die.

2. The resizing system as in claim 1 wherein the ram is attached to the push rod via a frame.

3. The resizing system as in claim 1 wherein the top surface of the ram is flat.

4. The resizing system as in claim 1 further comprising a handle system pivotally attached to the base and attached to the ram such that reciprocation of the ram is under control of the handle system.

5. The resizing system as in claim 1 further comprising a servomotor attached to the ram such that reciprocation of the ram is under control of the servomotor.

6. The resizing system as in claim 1 in combination with the resizing die.

7. The resizing system as in claim 6 wherein the ram is attached to the push rod via a frame.

8. The resizing system as in claim 6 wherein the top surface of the ram is flat.

9. The resizing system as in claim 6 further comprising a handle system pivotally attached to the base and attached to the ram such that reciprocation of the ram is under control of the handle system.

10. The resizing system as in claim 6 further comprising a servomotor attached to the ram such that reciprocation of the ram is under control of the servomotor.

* * * * *